US011255133B2

(12) United States Patent
Turner et al.

(10) Patent No.: US 11,255,133 B2
(45) Date of Patent: Feb. 22, 2022

(54) HARNESS FOR INTELLIGENT COMPLETIONS

(71) Applicant: SAUDI ARABIAN OIL COMPANY, Dhahran (SA)

(72) Inventors: Robert J. Turner, Dhahran (SA); Brett W. Bouldin, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 275 days.

(21) Appl. No.: 16/184,382

(22) Filed: Nov. 8, 2018

(65) Prior Publication Data

US 2020/0149356 A1 May 14, 2020

(51) Int. Cl.
*E21B 17/02* (2006.01)

(52) U.S. Cl.
CPC ..... *E21B 17/026* (2013.01); *E21B 17/028* (2013.01)

(58) Field of Classification Search
CPC ..... E21B 17/026; E21B 17/028; E21B 17/023
See application file for complete search history.

(56) References Cited

U.S. PATENT DOCUMENTS

| | | | |
|---|---|---|---|
| 5,152,343 | A | 10/1992 | Kilgore |
| 5,411,085 | A | 5/1995 | Moore et al. |
| 6,257,332 | B1 | 7/2001 | Vidrine et al. |
| 6,296,066 | B1 | 10/2001 | Terry et al. |
| 6,392,317 | B1 | 5/2002 | Hall et al. |
| 6,761,574 | B1 | 7/2004 | Song et al. |
| 6,868,906 | B1 | 3/2005 | Vail, III et al. |
| 7,032,658 | B2 | 4/2006 | Chitwood et al. |
| 7,036,601 | B2 | 5/2006 | Berg et al. |
| 7,398,697 | B2 * | 7/2008 | Allen ..... E21B 47/007 73/800 |

(Continued)

FOREIGN PATENT DOCUMENTS

| | | | |
|---|---|---|---|
| GB | 2337780 | A | 12/1999 |
| WO | 2018160328 | A1 | 9/2018 |

OTHER PUBLICATIONS

International Search Report and Written Opinion for related PCT application PCT/US2019/060619 dated Jan. 31, 2020.

*Primary Examiner* — Nicole Coy
(74) *Attorney, Agent, or Firm* — Bracewell LLP; Constance Gall Rhebergen

(57) ABSTRACT

A downhole tubing string and an umbilical harness are combined in a wellbore. The umbilical harness, which is formed remote from the wellbore, includes an umbilical, and umbilical connectors connected to lines in the umbilical. Connectors attach to well components and make up part of the downhole tubing string. The well components include valves, sensors, and actuators. The umbilical connectors attach to the umbilical at strategic locations so the umbilical connectors can reach and be mated to corresponding component connectors when the umbilical harness and downhole string are combined. Electricity, communication signals, or both, are transmitted along the lines in the umbilical, which are selectively conveyed to each component via the mated connectors. As the umbilical connectors are installed on the umbilical prior to wellsite delivery, the umbilical harness and downhole string are combined by engaging plugs on respective ends of umbilical connectors and corresponding ends of component connectors.

13 Claims, 4 Drawing Sheets

(56) References Cited

U.S. PATENT DOCUMENTS

| | | | | |
|---|---|---|---|---|
| 8,397,828 | B2 | 3/2013 | Hopmann et al. | |
| 8,403,066 | B2 * | 3/2013 | Meyyappan | E21B 17/1035 166/378 |
| 8,479,830 | B2 * | 7/2013 | Denoix | E21B 17/023 166/380 |
| 8,925,627 | B2 | 1/2015 | Tupper et al. | |
| 9,650,843 | B2 * | 5/2017 | Rayssiguier | H01R 13/6277 |
| 9,725,999 | B2 | 8/2017 | Castrogiovanni et al. | |
| 2004/0040707 | A1 | 3/2004 | Dusterhoff et al. | |
| 2010/0319936 | A1 | 12/2010 | Alff et al. | |
| 2011/0194817 | A1 * | 8/2011 | Hopmann | H01R 13/523 385/55 |
| 2011/0232921 | A1 | 9/2011 | Hopmann et al. | |
| 2013/0043048 | A1 * | 2/2013 | Joseph | E21B 43/128 166/381 |
| 2016/0201448 | A1 | 7/2016 | Patel | |

* cited by examiner

HARNESS FOR INTELLIGENT COMPLETIONS

BACKGROUND

1. Field

The present disclosure relates to establishing communication between components on a downhole string and surface. More specifically, the disclosure relates to providing a harness made up of an umbilical with prefabricated connectors; and mating the connectors with connectors that are attached to the components.

2. Related Art

Hydrocarbon producing wellbores often have tubular completion strings disposed within that are equipped with electric completion items at various depths along the string. Common examples of electric completion items are electrically actuated valves for controlling flow through the string; and sensors for monitoring conditions downhole. Umbilicals are sometimes deployed with the completion strings having electric completion items. The umbilicals typically contain one or more electrically conducting members for communicating signals, power, or both, to the electric completion items. Real time well monitoring and control of devices in the completion string is usually available by transmitting electricity along an umbilical, signals along the umbilical, or both electricity and signals along the umbilical, which is a feature commonly used in what are referred to as intelligent completions.

Connecting an electric umbilical to electric completion items in an intelligent completion currently requires the electric umbilical to be cut and connected to the electric completion items. Currently cutting and connecting operations are performed at the rig site (typically on the rig floor); to space-out the correct length of electric umbilical to the electric completion items. Performing these operations at the rig-site is expensive due to the significant rig-time required to build and test the connections. Connection of the metallic tubing of an umbilical is generally formed by welding or with a ferrule based compression fitting. Because hot work permit requirements must be fulfilled while welding at a rig site, most umbilical connections are made with ferrule compression fittings. Ferrule-based compression fittings used to join metallic tubulars are sometimes referred to as a "dry mate" or "splice" connection. Rig site assembly exposes the connections to wind, rain, sand, and contamination; which reduces connection quality and reliability to below that of connections made in a controlled workshop environment.

SUMMARY

Disclosed is an example method of completing a wellbore by providing an umbilical harness having an umbilical and an umbilical connector mounted to the umbilical that is in communication with lines in the umbilical, transporting the umbilical harness to the wellbore, providing a downhole string that includes a component, and providing communication between the component and the umbilical by connecting the umbilical connector to the component. In an example, the method further includes disposing the umbilical harness on a spool, and unspooling the umbilical harness at the wellbore. The downhole string and umbilical are optionally disposed into the wellbore. In one embodiment, electrically connecting the umbilical connector to the component involves mating a plug on an end of the umbilical connector with a receptacle that is electrically connected to the component. In an alternative, the method further includes, installing additional umbilical connectors to the umbilical harness so that each umbilical connector is in communication with a line in the umbilical, and installing additional components. The method further optionally includes identifying a location on the umbilical harness for placement of each of the umbilical connectors that corresponds with a location of a corresponding component, installing the umbilical connectors at those locations, and connecting each umbilical connector with the corresponding component. The umbilical connectors alternatively have lengths that vary, and wherein the downhole string is adjusted in accordance with the lengths of the umbilical connectors. Examples of the component include a sensor, a control valve, a component in a side pocket mandrel, and a safety valve. In an example, the component is powered with electricity in the umbilical harness. Signal data is optionally transmitted through the umbilical harness that is in communication with the component.

Another method of completing a wellbore involves connecting a plurality of umbilical connectors to an umbilical to form an umbilical harness, transporting the umbilical harness to the wellbore, forming a completion by mating the umbilical connectors with corresponding component connectors that connect to components disposed in a downhole string, and disposing the completion into the wellbore. The method optionally further includes, communicating with a one of the components through the umbilical harness. The method optionally includes adjusting a length of the downhole string to reduce a distance between a one of the umbilical connectors and a component connector that corresponds to the one of the umbilical connectors. In an example, the umbilical connectors are added to the umbilical at points along the distance of the umbilical, so that when the umbilical harness and downhole string are positioned next to and parallel with one another, each umbilical connector is in contactable distance with a corresponding component connector. A jumper is optionally added to a one of the component connectors and mated with an umbilical connector that corresponds to the a one of the component connectors when the corresponding umbilical connector is outside of a connectable distance.

An alternative method of completing a wellbore contains the steps of receiving an umbilical harness at a wellsite, the umbilical harness made up of an umbilical, conducting elements in the umbilical, and a plurality of umbilical connectors disposed along a length of the umbilical that are in communication with the conducting elements. Further included in the alternative method are the steps of receiving a downhole string at the wellsite, the downhole string having components, and component connectors that are in communication with the components; and engaging the umbilical connectors and corresponding component connectors. In an example, the method further includes, controlling a flow through the completion by transmitting electrical power and electrical signals along the umbilical harness and to a one of the components and via a connection that couples the a one of the components with a corresponding umbilical connector. One alternative step of the method is inserting the downhole string and umbilical harness into the wellbore at the same time. In one alternative, each umbilical connector is coupled to the umbilical harness at a designated point that is within a connectable distance with a corresponding component connector, and is connected to designated conducting elements in the umbilical, so that electrical power and signals is transmitted to a corresponding component according to a predefined design.

BRIEF DESCRIPTION OF DRAWINGS

Some of the features and benefits of that in the present disclosure having been stated, and others will become apparent as the description proceeds when taken in conjunction with the accompanying drawings, in which.

DETAILED DESCRIPTION

Figure 1:
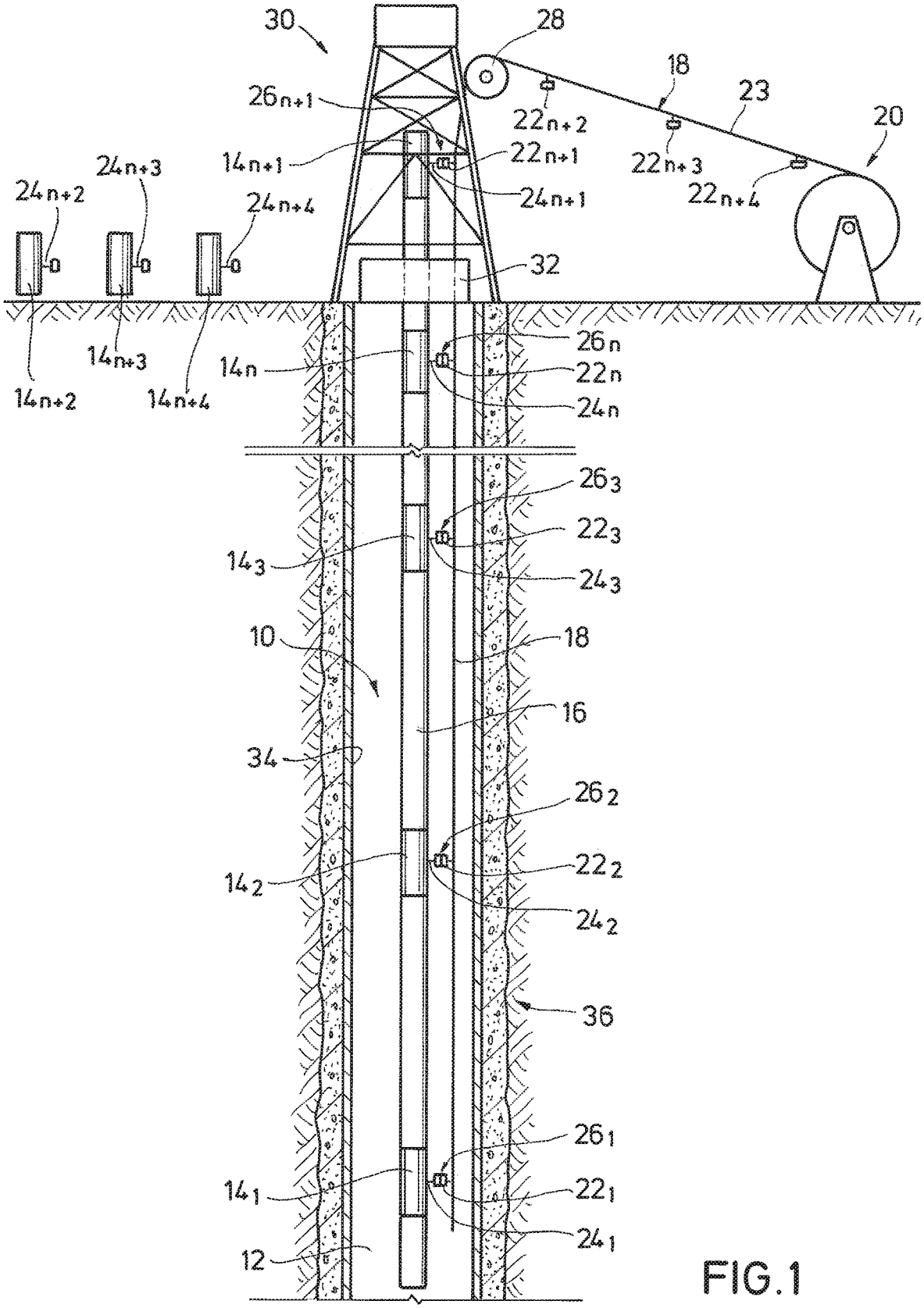
FIG. 1 is a partial sectional view of an example of a completion being formed in a wellbore by mating component connectors on a downhole string with umbilical connectors on an umbilical harness.

The method and system of the present disclosure will now be described more fully after with reference to the accompanying drawings in which embodiments are shown. The method and system of the present disclosure may be in many different forms and should not be construed as limited to the illustrated embodiments set forth; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, materials, or embodiments shown and described. Modifications and equivalents will be apparent to one skilled in the art. Illustrative examples have been disclosed in the drawings and specification. Although specific terms are employed they are used in a generic and descriptive sense only and not for the purpose of limitation.

Illustrated in a side partial sectional view in FIG. 1 is an example of an elongated downhole string 10 disposed in a wellbore 12, where the downhole string 10 includes a number of components $\mathbf{14}_{1\text{-}n+1}$ disposed at various locations along a length of the downhole string 10; where "1-n+1" means "1 to n+1", such as "1, 2, 3, . . . n, n+1". Also schematically illustrated are components $\mathbf{14}_{n+2}$, $\mathbf{14}_{n+3}$, $\mathbf{14}_{n+4}$, that in an example are to be added in the downhole string 10 at a later time. For the purposes of convenience, components $\mathbf{14}_{1\text{-}n+1}$, $\mathbf{14}_{n+2}$, $\mathbf{14}_{n+3}$, $\mathbf{14}_{n+4}$, are identified as $\mathbf{14}_{1\text{-}n+4}$. Tubing 16 is included with the downhole string 10, and which is generally coaxially mounted between adjacent ones of the components $\mathbf{14}_{1\text{-}n}$. Examples of the components $\mathbf{14}_{1\text{-}n+4}$ include devices deployed for use in the wellbore 12, such as valves, sensors, and actuators. Further in the example of FIG. 1, an embodiment of an umbilical harness 18 is shown being coupled with the downhole string 10 and being inserted into the wellbore 12 along with the downhole string 10. In the illustrated example, umbilical harness 18 is wound around a spool 20 and is shown having a number of umbilical connectors $\mathbf{22}_{1\text{-}n+4}$; where "1-n+4" means "1 to n+4", such as "1, 2, 3, . . . n+3, n+4". Umbilical harness 18 of FIG. 1 includes an umbilical 23 with the umbilical connectors $\mathbf{22}_{1\text{-}n+4}$ attached at various locations along a length of the umbilical 23. Attached to each of the components $\mathbf{14}_{1\text{-}n+4}$ are component connectors $\mathbf{24}_{1\text{-}n+4}$ that are in communication with the components $\mathbf{14}_{1\text{-}n+4}$. In an example, communicating with or connecting to a particular one of the component connectors $\mathbf{24}_{1\text{-}n+4}$, provides communication to one of the components $\mathbf{14}_{1\text{-}n+4}$ to which the particular component connector $\mathbf{24}_{1\text{-}n+4}$ is attached. In the example illustrated, the umbilical harness 18 is unwound or unspooled from the spool 20 and drawn adjacent the downhole string 10. As illustrated, the umbilical connectors $\mathbf{22}_{1\text{-}n+1}$ are connected to corresponding component connectors $\mathbf{24}_{1\text{-}n+1}$ while on surface and prior to being deployed inside the wellbore 12. Connections $\mathbf{26}_{1+n}$ are formed by mating umbilical connectors $\mathbf{22}_{1\text{-}n+1}$ with component connectors $\mathbf{24}_{1\text{-}n+1}$. The connections $\mathbf{26}_{n+1}$ provide communication, such as electrical and signal, between umbilical harness 18 and components $\mathbf{14}_{1\text{-}n+1}$. As noted previously, the remaining component connectors $\mathbf{24}_{n+2}$, $\mathbf{24}_{n+3}$, $\mathbf{24}_{n+4}$, are optionally mated with the remaining umbilical connectors $\mathbf{22}_{n+2}$, $\mathbf{22}_{n+3}$, $\mathbf{22}_{n+4}$ at a later time Described in more detail in the following text, in an alternative mating connectors 22, 24 provides communication between the umbilical 23 and devices (including intelligent electrically powered devices) provided within the components $\mathbf{14}_{1\text{-}n+4}$.

In the illustrated example of FIG. 1, umbilical harness 18 is equipped with the umbilical connectors $\mathbf{22}_{1\text{-}n+4}$ while mounted on the spool 20. In an example of use, the umbilical connectors $\mathbf{22}_{1\text{-}n+4}$ are installed on the umbilical 23 at a location remote from the wellsite W to form the umbilical harness 18. The umbilical harness 18 is then wound onto the spool 20 and transported to the wellsite W. In an alternative, the umbilical connectors $\mathbf{22}_{1\text{-}n+4}$ are configured such that they do not impede the umbilical harness 18 from passing over a sheave 28 shown proximate a drilling rig 30. A wellhead assembly 32, which alternatively provides pressure control of the wellbore 12, is schematically depicted at the base of drilling rig 30 and over wellbore 12. Axial passages (not shown) are formed in blowout preventer ("BOP") 32; and through which the string 10 and umbilical harness 18 are routed when being installed in the wellbore 12. Further included in the example of FIG. 1 is casing 34 shown lining the wellbore 12, and isolating wellbore 12 from a formation 36 surrounding wellbore 12. In one example, the downhole string 10 functions as a production string, and while inserted within casing 34 directs fluids produced from the formation 36 to surface. An advantage of the umbilical harness 18 having preinstalled umbilical connectors $\mathbf{22}_{1\text{-}n+4}$ is the step of cutting and splicing connectors onto the umbilical harness 18 at the wellsite W is eliminated, thereby reducing rig time and expense. An additional advantage of installing umbilical connectors $\mathbf{22}_{1\text{-}n+4}$ in a controlled environment is increased quality and reliability over that of the currently practiced method of cutting and connecting at the wellsite.

Figure 2:
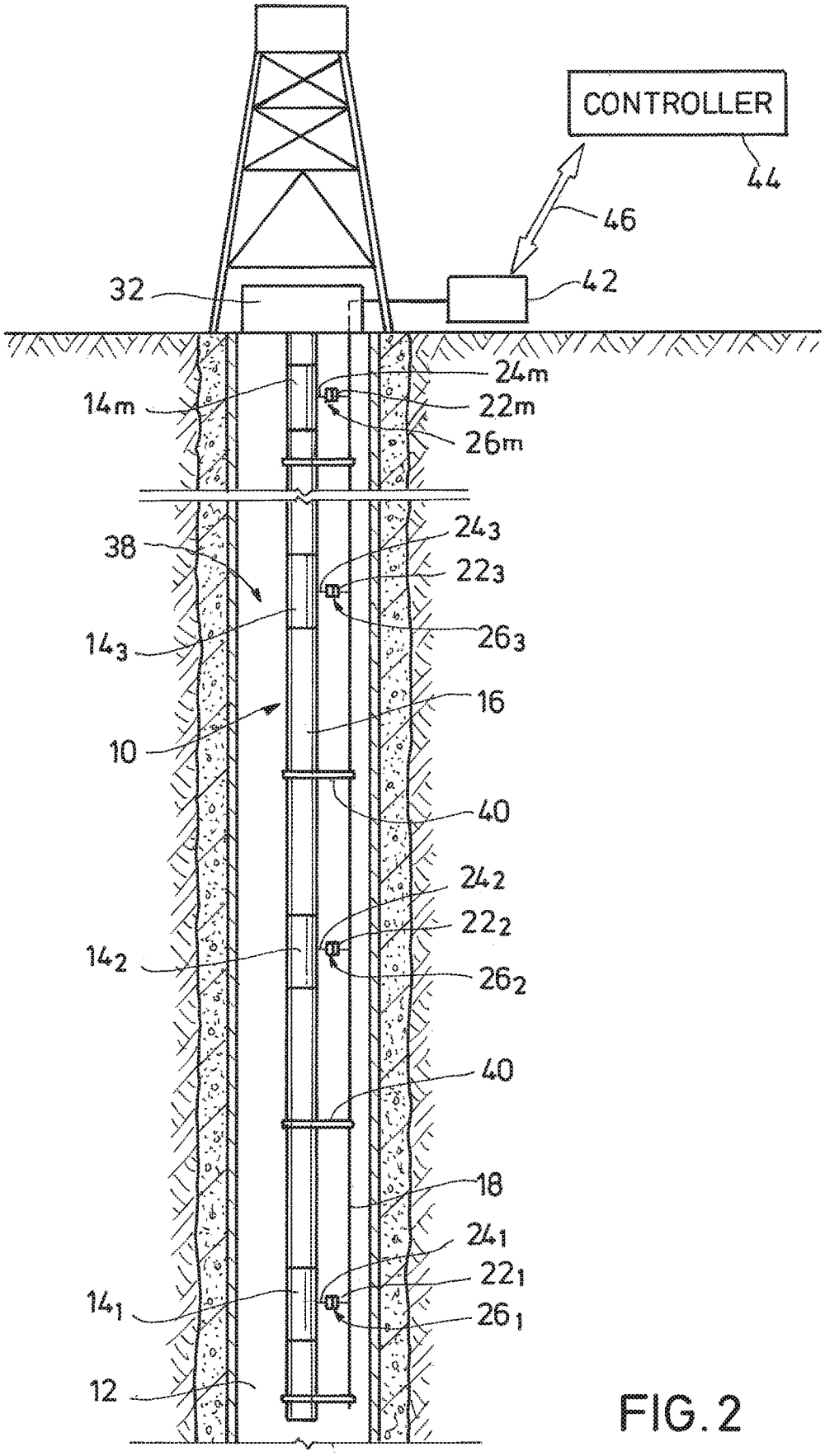
FIG. 2 is a partial sectional view of an embodiment of the completion of FIG. 1 installed in the wellbore.

Referring now to FIG. 2, shown in a side partial sectional view is an example of an intelligent completion 38 disposed in wellbore 12; and which includes tubing 16, umbilical harness 18, components $\mathbf{14}_{1\text{-}m}$, and connections $\mathbf{26}_{1\text{-}m}$; where "1-m" means "1 to m", such as "1, 2, 3, . . . m". In the example of FIG. 2, intelligent completion 38 is formed by coupling together the umbilical and connectors $\mathbf{22}_{1\text{-}m}$, $\mathbf{24}_{1\text{-}m}$ of FIG. 1. In this embodiment, there are m number of umbilical and component connectors ultimately engaged with one another; thus connections $\mathbf{26}_{1\text{-}m}$ are formed that provide electrical and signal communication between umbilical harness 18 and intelligent completion 38, including components $\mathbf{14}_{1\text{-}n}$ in intelligent completion 38, and any intelligent devices in intelligent completion 38. Additionally shown in FIG. 2 are optional clamps 40 securing the umbilical harness 18 to the string 10 to prevent unwanted movement that could uncouple one of the connections $\mathbf{26}_{1\text{-}m}$. In one embodiment, components $\mathbf{14}_{1\text{-}m}$ each include a housing to cover and protect components $\mathbf{48}_{1\text{-}m}$, $\mathbf{50}_{1\text{-}m}$, $\mathbf{52}_{1\text{-}m}$ from harsh downhole environments. The housings each alternatively include means for attachment (such as a threaded or flanged fitting) to the segments of tubing 16 between the adjacent components $\mathbf{14}_{1\text{-}m}$. As set forth in more detail in the following text, the umbilical harness 18 is assembled in accordance with an expected design of the downhole string 10 and so that a one of the umbilical connectors $\mathbf{22}_{1\text{-}m}$ is provided for each component connector $\mathbf{24}_{1\text{-}m}$. In a specific example, each umbilical connector $\mathbf{22}_{1\text{-}m}$ is installed at a designated point on the umbilical harness 18 in accordance with a design of the intelligent completion 38 to mate with a particular one of the intelligent connector harnesses $\mathbf{26}_{1\text{-}m}$. In a non-limiting example, a particular one of the intelligent connector harnesses $\mathbf{26}_{1\text{-}m}$ designated per design to mate with a particular umbilical connector $\mathbf{22}_{1\text{-}m}$ is referred to as a "corresponding" intelligent connector harness $\mathbf{26}_{1\text{-}m}$ and vice versa. For purposes of discussion, in an example an umbilical connector $\mathbf{22}_{1\text{-}m}$ is also referred to as corresponding to a particular component $\mathbf{14}_{1\text{-}m}$ on which its corresponding intelligent connector harness $\mathbf{26}_{1\text{-}m}$ is attached.

Further illustrated in the example of FIG. 2 is a terminal 42 disposed outside of wellbore 12 and which couples to an end of umbilical harness 18 disposed outside of wellbore 12. Umbilical harness 18 is in communication with controller 44 via a communication means 46, accordingly intelligent completion 38 and all devices (such as components $\mathbf{14}_{1\text{-}n}$) within intelligent completion 38 are in communication with controller 44 via connections $\mathbf{26}_{1\text{-}m}$, umbilical harness 18, terminal 42, and communication means 46. In an example controller 44 includes an information handling system ("IHS") employed for controlling electrical signals and power along umbilical harness 18. The IHS optionally stores recorded data as well as processing the data into a readable format. Embodiments exist where the IHS includes a processor, memory accessible by the processor, nonvolatile storage area accessible by the processor, and logics for performing each of the steps described. Illustrative communication means 46 include those that employ a conducting medium, fiber optic media, receive and transmit electromagnetic waves, and combinations thereof. In one non limiting example of operation, information obtained by electrical devices within string 10 are transmitted via umbilical harness 18 to terminal 42 and via communication means 46 to controller 44. Alternatively, control commands are selectively issued by controller 44 that transmit through umbilical harness 18 to one or more of the components $\mathbf{14}_{1\text{-}m}$, and electrical power for operating the various intelligent devices within string 10 is transmitted along the umbilical harness 18. In an example, a power source (not shown), that optionally includes a variable frequency drive, is provided on surface that provides electrical power, such as electricity; and which is conducted by umbilical harness 18 into the wellbore 12.

Figure 3:
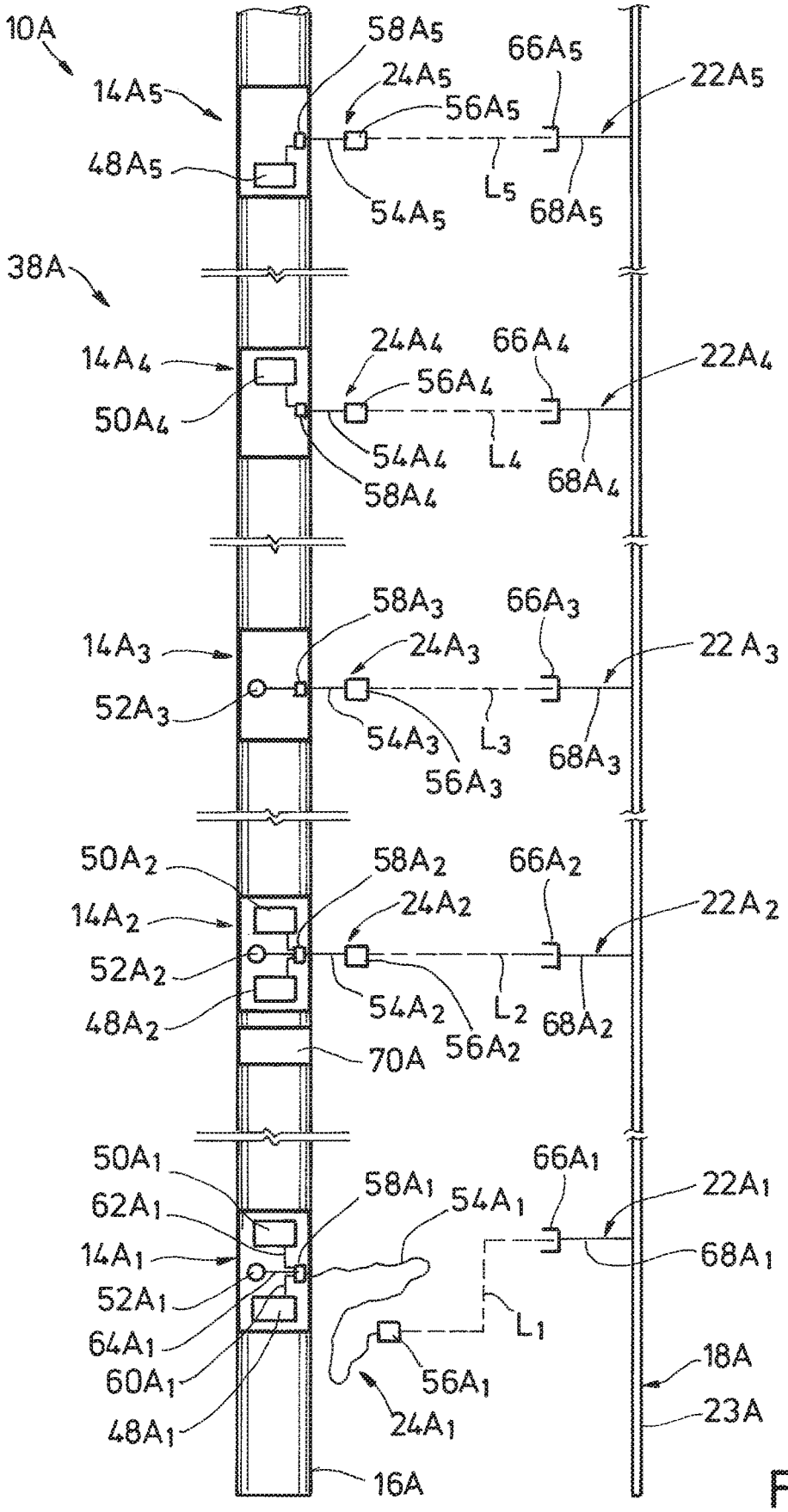
FIG. 3 is a schematic view of an example of portions of the downhole string and umbilical harness of FIG. 1.

Referring now to FIG. 3, schematically illustrated is an example of coupling downhole string 10A with umbilical harness 18A to form intelligent completion 38A. In the illustrated example, downhole string 10A includes components $\mathbf{14}\mathrm{A}_{1\text{-}5}$ disposed in tubing 16A, and where components $\mathbf{14}\mathrm{A}_{1\text{-}5}$ have a different assortment of devices. Examples exist where at least some of the devices are electrically powered. Alternatively, at least some of the devices handle electrical signals, such as by transmitting, receiving, or both. More specifically, component $\mathbf{14}\mathrm{A}_1$ includes component $\mathbf{48}\mathrm{A}_1$, component $\mathbf{50}\mathrm{A}_1$ and component $\mathbf{52}\mathrm{A}_1$. Components $\mathbf{48}\mathrm{A}_1$, $\mathbf{50}\mathrm{A}_1$ are schematically illustrated to represent valves, examples of which include a control valve, an on/off valve, and a safety valve. Component $\mathbf{52}\mathrm{A}_1$ is schematically represented to illustrate a sensor, such as for measuring pressure or temperature within the wellbore 12 (FIG. 2). Further in this example, the component connectors $\mathbf{24}\mathrm{A}_{1\text{-}5}$ include lines $\mathbf{54}\mathrm{A}_{1\text{-}5}$ that provide electrical communication between the devices in the components $\mathbf{14}\mathrm{A}_{1\text{-}5}$ and plugs $\mathbf{56}\mathrm{A}_{1\text{-}5}$ shown mounted respectively on ends of the lines $\mathbf{54}\mathrm{A}_{1\text{-}5}$ distal from the components $\mathbf{14}\mathrm{A}_{1\text{-}5}$. Junctions $\mathbf{58}\mathrm{A}_{1\text{-}5}$ are optionally provided in each of the components $\mathbf{14}\mathrm{A}_{1\text{-}5}$, which in an example provide a connection point for each of the lines $\mathbf{54}\mathrm{A}_{1\text{-}5}$. In an alternate embodiment, leads $\mathbf{60}\mathrm{A}_1$, $\mathbf{62}\mathrm{A}_1$ and $\mathbf{64}\mathrm{A}_1$ are provided in component $\mathbf{14}\mathrm{A}_1$ and that provide electrical communication respectively between junction $\mathbf{58}\mathrm{A}_1$ and components $\mathbf{48}\mathrm{A}_1$, $\mathbf{50}\mathrm{A}_1$, and $\mathbf{52}\mathrm{A}_1$. Receptacles $\mathbf{66}\mathrm{A}_{1\text{-}5}$ are included in the illustrated embodiment, and which are shown mounted on ends of umbilical connectors $\mathbf{22}\mathrm{A}_{1\text{-}5}$ distal from umbilical 23A. As illustrated by the dashed lines $\mathrm{L}_{1\text{-}5}$, plugs $\mathbf{56}\mathrm{A}_{1\text{-}5}$ collectively engage and mate with receptacles $\mathbf{66}\mathrm{A}_{1\text{-}5}$ to provide electrical and signal communication from and between umbilical connectors $\mathbf{22}\mathrm{A}_{1\text{-}5}$ and component connectors $\mathbf{24}\mathrm{A}_{1\text{-}5}$. Lines $\mathbf{68}\mathrm{A}_{1\text{-}5}$ electrically connect the umbilical receptacles $\mathbf{66}\mathrm{A}_{1\text{-}5}$ with electrically conducting members within umbilical harness 18A. Examples of the junctions $\mathbf{58}\mathrm{A}_{1\text{-}5}$ include pigtail type connections between electrically conducting members (not shown) in lines $\mathbf{54}\mathrm{A}_{1\text{-}5}$ and those in components $\mathbf{14}\mathrm{A}_{1\text{-}5}$. Optionally, junctions $\mathbf{58}\mathrm{A}_{1\text{-}5}$ are made up of receptacle and plug like connections similar to plugs $\mathbf{56}\mathrm{A}_{1\text{-}5}$ and receptacles $\mathbf{66}\mathrm{A}_{1\text{-}5}$.

In one alternative, the different components $\mathbf{14}\mathrm{A}_{1\text{-}5}$ illustrated in FIG. 3 are equipped with a different type and number of devices. For example, while components $\mathbf{14}\mathrm{A}_1$ and $\mathbf{14}\mathrm{A}_2$ include each of the components $\mathbf{48}\mathrm{A}_{1,\,2}$, $\mathbf{50}\mathrm{A}_{1,\,2}$, and $\mathbf{52}\mathrm{A}_{1,\,2}$, the remaining components $\mathbf{14}\mathrm{A}_{2\text{-}5}$ include a single one of the completion devices. More specifically component $\mathbf{14}\mathrm{A}_3$ of FIG. 3 is shown having component $\mathbf{52}\mathrm{A}_3$, component $\mathbf{14}\mathrm{A}_4$ is shown including completion device $\mathbf{50}\mathrm{A}_4$, and component $\mathbf{14}\mathrm{A}_5$ includes component device $\mathbf{48}\mathrm{A}_5$. The components are not limited to the embodiments illustrated, but can include any number of other combinations.

Still referring to FIG. 3, the embodiment of the line $\mathbf{54}\mathrm{A}_1$ shown has a length greater than that of lines $\mathbf{54}\mathrm{A}_{2\text{-}5}$, and in an example takes the form of what is referred to as a length extension or jumper. An advantage of a line $\mathbf{54}\mathrm{A}_1$ having an increased length is realized if the receptacle $\mathbf{66}\mathrm{A}_1$ to be engaged by the plug $\mathbf{56}\mathrm{A}_1$ on the end of the line $\mathbf{54}\mathrm{A}_1$ is vertically offset from the corresponding component $\mathbf{14}\mathrm{A}_1$ a distance that is greater than that which a harness line typically spans. Optionally, jumper includes readymade connectors on its opposing ends, such as a plug (the same or similar to one of plugs $\mathbf{56}\mathrm{A}_{1\text{-}5}$) on one end of its length of electrically conducting members, and a receptacle (the same or similar to one of receptacles $\mathbf{66}\mathrm{A}_{1\text{-}5}$) on an opposing end of the conducting members. In this example of jumper, its plug and receptacle (not shown) engage one of receptacles $\mathbf{66}\mathrm{A}_{1\text{-}5}$ and its corresponding one of the plugs $\mathbf{56}\mathrm{A}_{1\text{-}5}$, which readily provides communication between one of components $\mathbf{14}\mathrm{A}_{1\text{-}5}$ and a corresponding umbilical connector $\mathbf{22}\mathrm{A}_{1\text{-}5}$. In another alternative, an optional pup joint 70A is added to string 10A to adjust the vertical position of a one or more of the components $\mathbf{14}\mathrm{A}_{1\text{-}5}$ into close enough alignment with a corresponding one of the receptacles 66$A_{1-n}$ so that a one of the plugs 56$A_{1-n}$ mates with a corresponding one of the receptacles 66$A_{1-n}$ by normal extension of corresponding ones of the lines 54$A_{1-n}$ and lines 68$A_{1-n}$.

Figure 4:
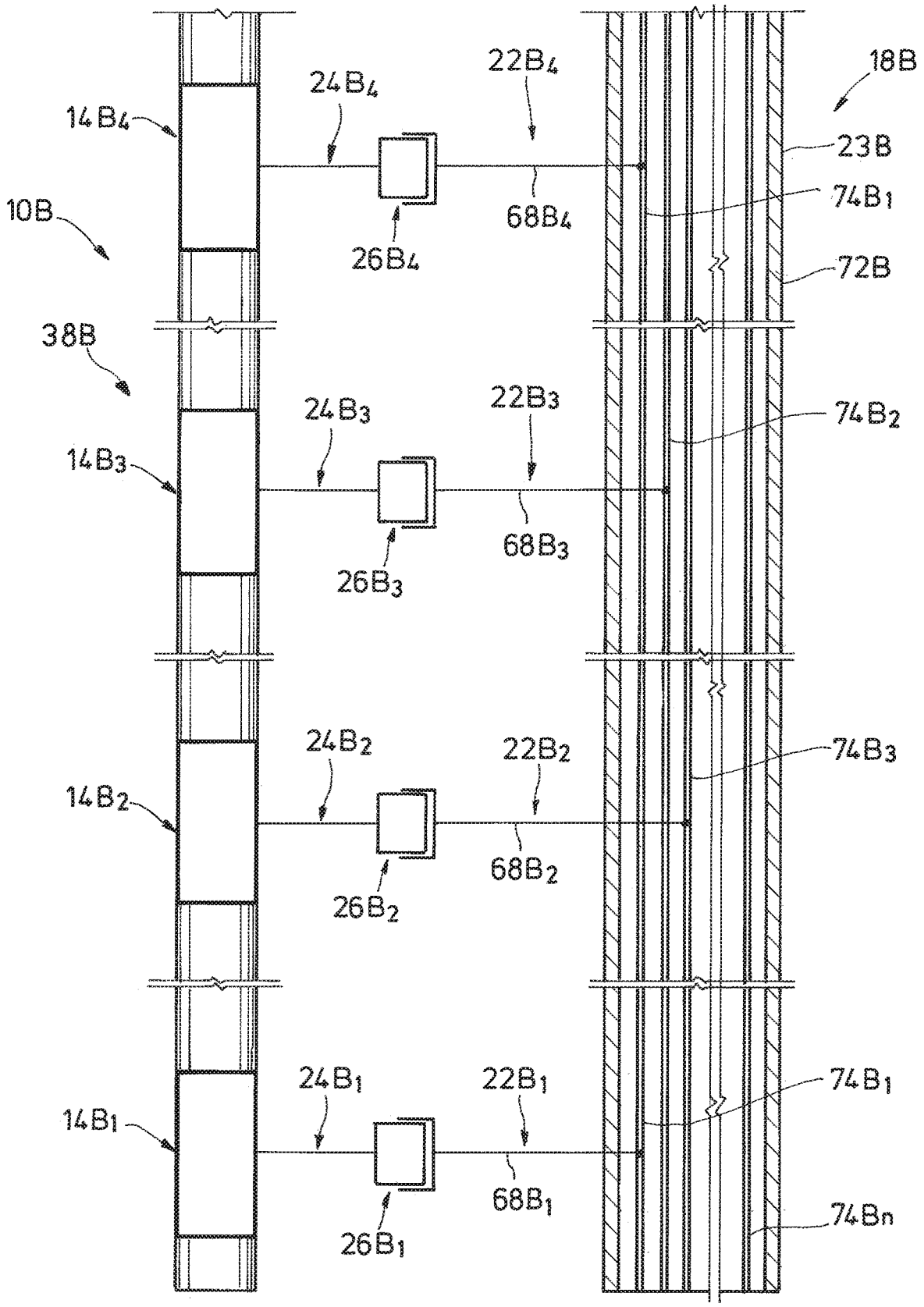
FIG. 4 is a schematic view of umbilical connectors attached to conducting elements in the umbilical.

Schematically illustrated in a partial sectional view in FIG. 4 is an example of a portion of the intelligent completion 38B where the completion string 10B is electrically coupled with umbilical harness 18B via connections 26$B_{1-4}$. Here, the connections 26$B_{1-4}$ provide electrical communication between the components 14$B_{1-4}$ and the umbilical harness 18B, and formed by mating umbilical connectors 22$B_{1-4}$ with component connectors 24$B_{1-4}$. In this example, umbilical harness 18B includes an outer sheath 72B encasing a number of elongated conducting elements 74$B_{1-n}$. Example materials for the sheath 72B include metal or metallic substances, and alternatively formed into a tubular shape. Further shown is line 68$B_1$ in electrical communication with conducting element 74$B_1$, thus component 14$B_1$ is in communication with the conducting element 74$B_1$ via component connector 24$B_1$ and connection 26$B_1$. Similarly, umbilical harness line 68$B_2$ is shown connected to conducting element 74$B_3$ which thereby puts the component 14$B_2$ in communication with conducting element 74$B_3$. Conducting element 74$B_2$ is in electrical communication with component 14$B_3$ via communication between line 68$B_3$ and component connector 24$B_3$ via connection 26$B_3$. Further, also connected to conducting element 74$B_1$ is line 68$B_4$, to in turn provide electrical communication with component 14$B_4$ and conducting element 74$B_1$. Accordingly, examples exist where different ones of the components 14$B_{1-4}$ are in electrical communication with the same one of the conducting elements 74$B_{1-n}$. Examples exist where embodiments of the umbilical harness 18, 18A, 18B include umbilical 23, 23A, 23B having media that communicates multiple types of energy, such as electric, fiber-optic, acoustic, pressure, and combinations thereof.

In one non-limiting example of operation, an umbilical harness is formed having a number of elongated conducting elements disposed within a sheath (such as that described above). A design of an intelligent completion is obtained, and which includes the types and respective positions of completion assemblies included on intelligent completion. Knowing the arrangement and type of the completion assemblies in the intelligent completion, locations on the umbilical harness are identified where to install umbilical connectors. The configurations and placements of component connectors as expected from the design of the intelligent completion are taken into account when identifying the locations of where the umbilical connectors are to be installed on the umbilical to form the umbilical harness. Also identified are the conducting elements on which to connect the umbilical harness lines. In an example as discussed in the foregoing, the umbilical connectors are mounted to the umbilical at the identified points while at a location remote from the wellsite, and which is sheltered from environmental elements capable of degrading connections between the umbilical connectors and the umbilical harness.

Further in the example of operation, the umbilical harness is strategically located to position umbilical connectors sufficiently close to corresponding component connectors. In one example, umbilical connectors are sufficiently close to corresponding component connectors when they are connectable without repositioning either of the umbilical harness or downhole string, or altering the lines of either of the umbilical connectors or the component connectors. An example of an umbilical connector being connectable to a corresponding component connector is that plug of component connectors engages with receptacle of umbilical connector to form a connection. Explained another way, the umbilical and component connectors are sufficiently close to one another, or are within a connectable distance, when lines of the umbilical and component connectors have a combined length that exceeds a distance between where the component connector and umbilical connector connect to the downhole string and umbilical harness respectively.

Additional alternate steps of this non-limiting example include winding the umbilical harness with attached umbilical connectors onto a spool, and transporting the umbilical harness to the wellsite. At the wellsite, completion assemblies and sections of tubing are assembled to form the string, which is inserted into the wellbore. In an alternate embodiment, prior to inserting each of the completion assemblies into the wellbore, attached component connectors are mated with corresponding umbilical connectors to form connections. Mating connectors to one another places controller into communication with one or more of the completion devices in the intelligent completion. In an example, the communication occurs along the umbilical harness. Communication includes electricity and signals that are transmitted along the umbilical harness. Example signals include instruction for operating devices in the completion or otherwise disposed in wellbore. The types of signals communicated include electrical signals, acoustic signals, and electro-magnetic signals. Electricity is available for energizing such devices, such as for powering a motor that drives a valve member to a designated position.

The present disclosure therefore is well adapted to carry out the objects and attain the ends and advantages mentioned, as well as others inherent. While embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method of completing a wellbore comprising:

obtaining an umbilical harness comprising an umbilical and umbilical connectors mounted to the umbilical, the umbilical connectors each comprising a receptacle and an umbilical connector line that is in communication with the receptacle and a line in the umbilical;

assembling a downhole string in accordance with a design, the downhole string comprising sections of tubing, components, and component connectors that each comprise a plug and a component connector line in communication with the plug and one of the components;

providing a jumper comprising a jumper plug, a jumper receptacle connected to the jumper plug with electrically conducting members;

identifying the receptacle from one of the umbilical connectors that is vertically offset from the plug of one of the corresponding component connectors; and providing communication between the component and the umbilical by connecting the jumper plug with the receptacle from the umbilical connector and the jumper receptacle with the plug from the corresponding component connector.

2. The method of claim 1, further comprising disposing the umbilical harness on a spool, and unspooling the umbilical harness proximate the wellbore.

3. The method of claim 2, further comprising disposing the downhole string and umbilical harness into the wellbore.

4. The method of claim 1 further comprising, installing additional umbilical connectors to the umbilical harness so that each umbilical connector is in communication with the line in the umbilical, and installing additional components.

5. The method of claim 4, wherein the umbilical connectors have lengths that vary, and wherein the downhole string is adjusted in accordance with the lengths of the umbilical connectors.

6. The method of claim 1, wherein the component comprises a device selected from the list consisting of a sensor, a control valve, a component in a side pocket mandrel, and a safety valve.

7. The method of claim 1, further comprising powering the component with electricity in the umbilical harness.

8. The method of claim 1, further comprising transmitting signal data through the umbilical harness that is in communication with the component.

9. The method of claim 1, wherein the umbilical harness is assembled at a location selected from the group consisting of proximate the wellbore and distal from the wellbore.

10. A method of completing a wellbore comprising:

connecting a plurality of umbilical connectors to an umbilical to form an umbilical harness and at spaced apart locations on the umbilical that correspond to locations of components in an expected design of a downhole string, the umbilical connectors comprising connector lines and receptacles in communication with and connected to the umbilical by the connector lines;

forming a completion by extending the receptacles a distance from the umbilical and mating the receptacles with corresponding component connectors that connect to the components disposed in the downhole string;

identifying where receptacles are vertically offset from locations of corresponding component connectors so that an umbilical connector and a corresponding component connector are outside of a connectable distance from one another;

providing communication between the receptacles and the corresponding component connectors with an extension having an extension plug connected to an extension receptacle by electrically conducting members, and by connecting the extension plug to the receptacle and connecting the extension receptacle to the plug; and disposing the completion into the wellbore.

11. The method of claim 10 further comprising, communicating with a one of the components through the umbilical harness.

12. The method of claim 10 wherein the step of adjusting a length of the downhole string reduces a distance between a one of the umbilical connectors and a component connector that corresponds to the one of the umbilical connectors.

13. The method of claim 10, wherein the umbilical connectors are added to the umbilical at points along the distance of the umbilical, so that when the umbilical harness and downhole string are positioned next to and parallel with one another, each umbilical connector is in contactable distance with a corresponding component connector.

* * * * *